US008381407B1

(12) United States Patent
White

(10) Patent No.: US 8,381,407 B1
(45) **Date of Patent: *Feb. 26, 2013**

(54) EXCHANGE BLADE KNIFE

(76) Inventor: James Dale White, Wasilla, AK (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/968,042

(22) Filed: Dec. 14, 2010

Related U.S. Application Data

(63) Continuation of application No. 11/895,906, filed on Aug. 28, 2007, now Pat. No. 7,900,363.

(60) Provisional application No. 60/840,541, filed on Aug. 28, 2006.

(51) Int. Cl.

| | |
|---|---|
| ***B26B 3/06*** | (2006.01) |
| ***B26B 1/00*** | (2006.01) |
| ***B25G 1/00*** | (2006.01) |
| ***B25G 1/12*** | (2006.01) |
| ***B25G 3/00*** | (2006.01) |

(52) U.S. Cl. ..... 30/340; 30/339; 30/157; 30/329

(58) Field of Classification Search ..... 30/340, 30/351, 356, 151, 155, 157, 286, 329, 330, 30/337, 339

See application file for complete search history.

(56) References Cited

U.S. PATENT DOCUMENTS

| | | | | |
|---|---|---|---|---|
| 1,035,548 | A | | 8/1912 | Dickenson |
| 1,436,740 | A | | 11/1922 | Wesson |
| 1,539,141 | A | | 5/1925 | Peterson |
| 1,829,499 | A | | 10/1931 | Boos |
| 1,914,153 | A | * | 6/1933 | Ogden ..... 30/339 |
| 2,075,553 | A | | 3/1937 | Storfer |
| 2,104,276 | A | * | 1/1938 | Schmidt ..... 30/331 |
| 2,191,276 | A | * | 2/1940 | Gardner et al. ..... 30/330 |
| 3,377,703 | A | | 4/1968 | Longobardi |
| 3,781,988 | A | * | 1/1974 | Jones ..... 30/2 |
| 3,996,665 | A | * | 12/1976 | Malchow ..... 30/331 |
| 4,017,969 | A | | 4/1977 | Stonebraker |
| 5,272,812 | A | | 12/1993 | Doucette |
| 5,522,828 | A | | 6/1996 | Malilay |
| 6,105,260 | A | | 8/2000 | Parrish et al. |
| 2,478,668 | A1 | | 10/2001 | Shepard et al. |
| 6,718,637 | B1 | | 4/2004 | Ortner et al. |
| 7,040,022 | B2 | * | 5/2006 | Ping ..... 30/161 |
| 7,055,248 | B2 | | 6/2006 | Cote |
| 7,900,363 | B1 | * | 3/2011 | White ..... 30/340 |
| 2005/0138816 | A1 | | 6/2005 | Ping |

* cited by examiner

*Primary Examiner* — Ghassem Alie
*Assistant Examiner* — Bharat C Patel

(57) ABSTRACT

An exchange blade knife includes a replaceable blade, a blade holder and a blade lock. The replaceable blade includes an opening adjacent to its base edge. The blade holder includes a blade recess for receiving the replaceable blade and a boss corresponding to the opening in the blade which projects from the surface of the blade recess. The boss has a low portion that is no thicker than the replaceable blade and a raised portion that extends above the surface of the replaceable blade. The blade lock pivots on the blade holder between an opened position for receiving the replaceable blade and a closed position for retaining the replaceable blade. The blade lock also includes an opening for receiving the boss of the blade holder.

5 Claims, 10 Drawing Sheets

EXCHANGE BLADE KNIFE

CROSS REFERENCES TO RELATED APPLICATIONS

This application is a continuation of U.S. application Ser. No. 11/895,906 filed on Aug. 28, 2007, which is incorporated herein by reference.

U.S. application Ser. No. 11/895,906 claimed the benefit of U.S. Provisional Patent Application No. 60/840,541 filed on Aug. 28, 2006.

FIELD

This invention relates to a knife having a blade that can be removed and replaced.

BACKGROUND

A knife of the finest quality and craftsmanship with a dull cutting edge is less useful than the cheapest knife having a sharp cutting edge. Yet, a significant amount of skill is needed to properly sharpen a knife. Professionals who use knives in their work, such as professional chefs, often invest the effort needed to learn the skill of knife sharpening and honing, and, they maintain that skill through frequent practice. This is usually not the case with the general public. Consequently, most knives in general use are not properly honed. It is often the case that a consumer buys an expensive, high quality knife and is initially impressed with its fine sharp cutting edge. Yet, after a few months of use, the formerly proud knife owner is disappointed with a knife which "can't seem to hold its edge". The knife owner may try to sharpen the knife with a sharpening stone or the like. But more often that not, the knife owner cannot seem to regain that original "factory edge". The knife owner may even give up and buy a new knife. What is needed is a knife that has a replaceable blade which in all important respects functions as typical knife.

SUMMARY

The above stated need is met by a replacement blade knife which includes a handle, a blade holder mounted to the handle, a replaceable blade and a blade lock for fixing the replaceable blade to the blade holder. The replaceable blade includes an opening adjacent to its base edge. The blade holder includes a blade recess for receiving the replaceable blade and a boss corresponding to the opening in the blade which projects from the surface of the blade recess. The boss has a thin portion that is no thicker than the replaceable blade and a thick portion that is thicker than the replaceable blade. The blade lock is pivotably mounted to the blade holder for pivoting between an opened position for receiving the replaceable blade and a closed position for retaining the replaceable blade. The blade lock also includes an opening corresponding to the boss of the blade holder. The blade holder boss is oriented so that the edge of the blade lock first encounters the thin portion of the boss as the blade lock is pivoted from the opened position toward the closed position. As the blade lock continues to pivot, the blade lock rides up on the thicker portion of the boss until the blade lock opening receives the thick portion of the boss and thus retains the blade lock in the closed position. When the blade lock opening receives the thick portion of the boss, the blade lock springs back into contact with the blade holder and the blade. The blade lock is opened to remove a replaceable blade by applying opposite pressure to the distal end of the blade lock. In order for the blade lock to open, the portion of the blade lock adjacent to the blade lock opening must pop back up onto the blade holder boss. If one or both of the edges of the blade holder boss or the blade lock opening which make contact when opposite opening pressure is applied are slightly rounded or beveled, then the blade lock can pop back up onto the blade holder boss when sufficient opening pressure is applied.

DETAILED DESCRIPTION

Figure 1A:
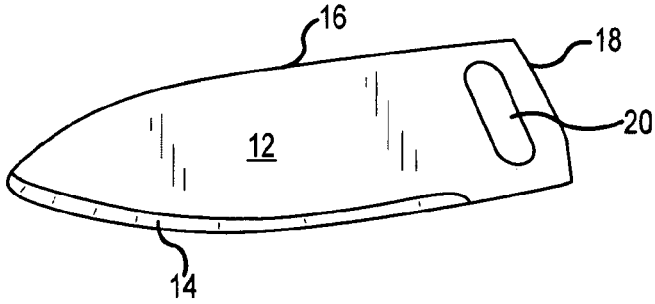
FIG. 1A is a side view of the removable blade of the exchange blade knife shown removed from the exchange blade knife of FIG. 1.
Figure 1:
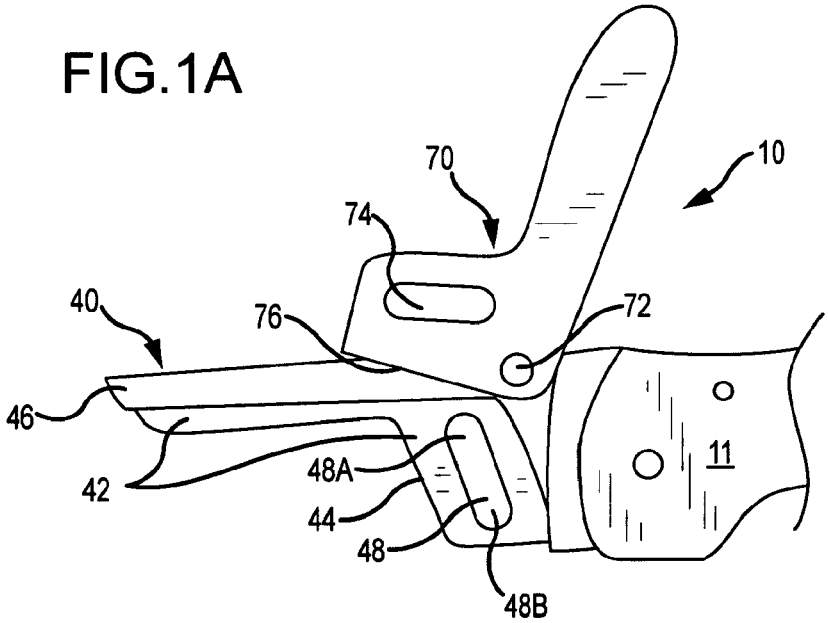
FIG. 1 is a side view of the exchange blade knife shown with the replaceable blade removed.

Referring to FIGS. 1 and 1A, an example replacement blade knife 10 is shown to include a handle 11, a replaceable blade 12, a blade holder 40 and a blade lock 70. As can be seen in FIG. 1, blade holder 40 is mounted to handle 11 and blade lock 70 is pivotably mounted to blade holder 40 at pivot joint 72.

As can be seen in FIGS. 1 and 1A, replaceable blade 12 includes a cutting edge 14, an opposite back edge 16 and a base edge 18. Cutting edge 14 and back edge 16 preferably meet at the tip of the knife. Base edge 18 extends between the base of back edge 16 and the base of cutting edge 14. Replaceable blade also has an opening 20 adjacent to base edge 18, which in this example is elongated and oriented generally parallel to base edge 18 as is shown in FIG. 1. One of the benefits of this exchange blade knife is that replaceable blade 12 may be replaced by a variety of blades, saw blades or even tool elements. Replaceable blade 12 may be discarded when removed or perhaps more preferably returned to the manufacturer for re-sharpening.

Blade holder 40 is mounted to handle 11 and includes a blade recess 42 for receiving replaceable blade 12. Blade holder 40 may be fixed to handle 11 or optionally may be pivotably mounted to handle 11. If blade holder 40 is pivotably mounted to handle 11, then handle 11 would be slotted to accommodate blade holder 40, blade lock 70 and blade 12 in the same well known way the handle of a typical folded blade knife accommodates a pivoting blade. Blade holder 40 is generally "L" shaped. Blade holder 40 includes a relatively short base portion 44 at its proximate end for supporting the portion of the replaceable blade adjacent to replaceable blade's base edge 18 and a relatively long back edge portion 46 which extends to its distal end. Back edge portion 46 supports the back edge 16 of replaceable blade 12. Blade holder 40 includes a back surface which is preferably generally flat and a front surface which includes a blade recess 42 for receiving replaceable blade 12. Blade recess 42 of the blade holder 40 preferably extends over most of back edge portion 46 and base portion 44 of blade holder 40. Blade recess 42 is bounded on its upper edge by a back surface 42A which has a width corresponding to the thickness of blade 12 and which is located to receive back edge 16 of blade 12. Blade recess 42 is bounded at its base edge by a base surface 42B which also has a width corresponding to the thickness of blade 12 and is located to receive base edge 18 of blade 12.

Blade recess 42 of base portion 44 is also interrupted by a projecting boss 48. Boss 48 provides two functions in this example. First, boss 48 is received by opening 20 of blade 12 to further secure the position of blade 12 relative to blade holder 40. Second, boss 48 provides a means for locking blade lock 70 in the closed position. In this example, the upper surface of boss 48 varies in its offset from the surface of blade recess 42 from a relatively low portion 48A adjacent to back surface 42A of blade recess 42 to a relatively high portion 48B generally opposite from back surface 42A. Low portion 48A of boss 48 preferably does not extend above the upper surface of replaceable blade 12 when replaceable blade 12 is received by blade recess 42. High portion 48B of boss 48 is preferably at least sufficiently raised above the upper surface of replaceable blade 12 to cause boss 48 to be securely captured by a corresponding boss opening 74 in blade lock 70 as will be described in greater detail below. It is preferable that blade holder 40 be fashioned from a hard, strong material such as stainless steel.

Figure 2A:
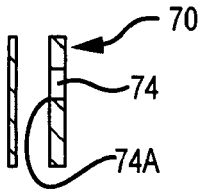
FIG. 2A is a cross section view of the blade lock of the exchange blade knife taken from plane A-A of FIG. 2.
Figure 2:
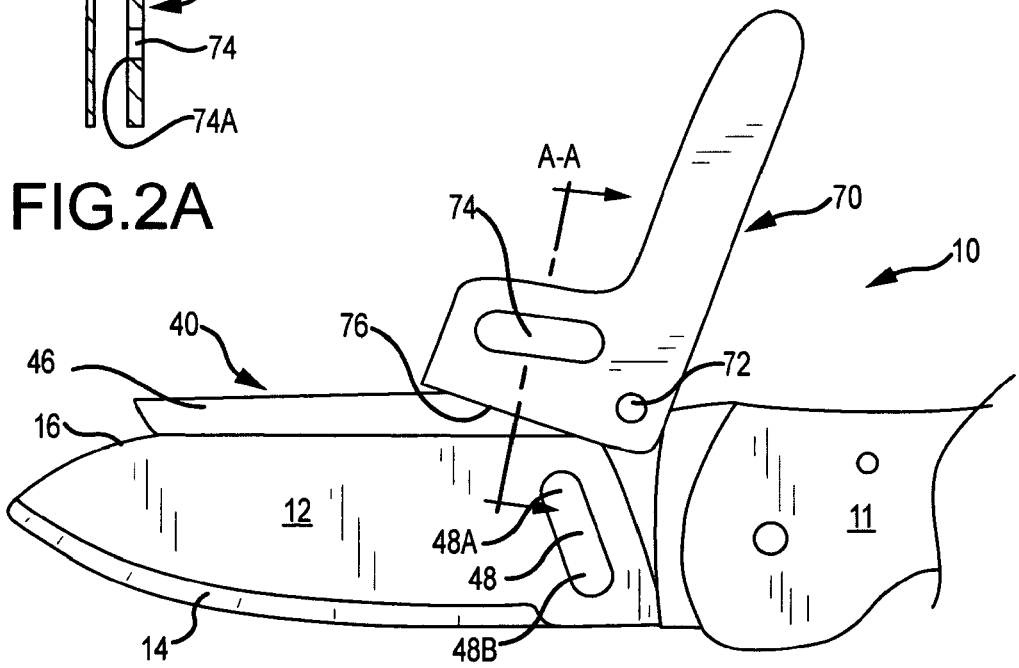
FIG. 2 is a side view of the exchange blade knife shown with the replaceable blade in place and the blade lock in the opened position.
Figure 3:
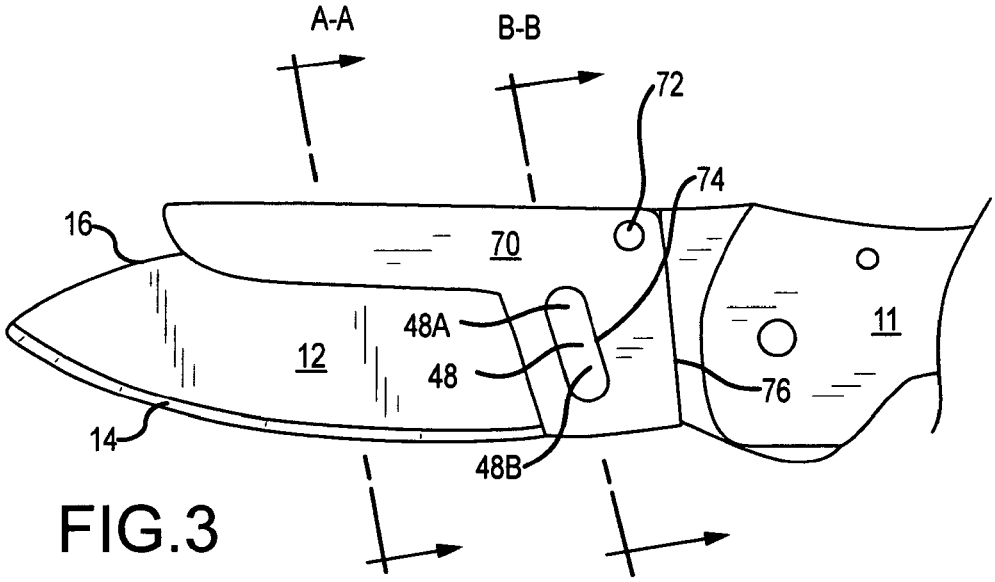
FIG. 3 is a side view of the exchange blade knife shown with the replaceable blade in place and the blade lock in the closed position.
Figure 3A:
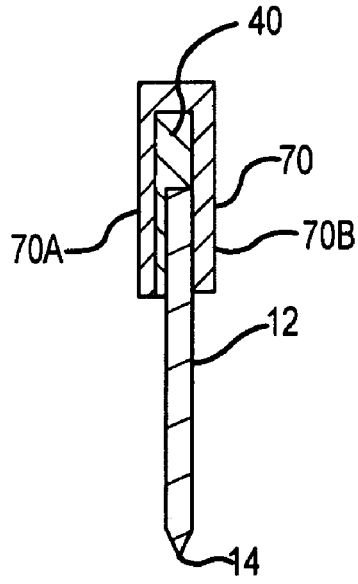
FIG. 3A is a cross section view of the exchange blade knife taken from plane A-A of FIG. 3.
Figure 3B:
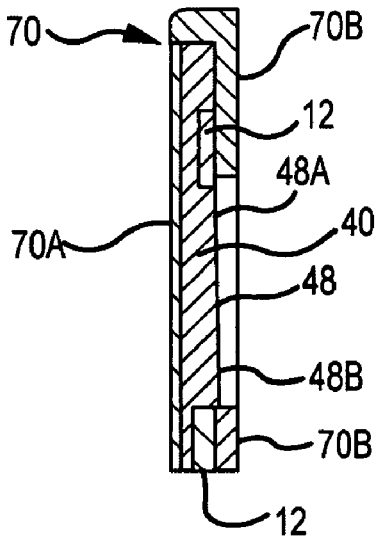
FIG. 3B is a cross section view of the exchange blade knife taken from plane B-B of FIG. 3.
Figure 5A:
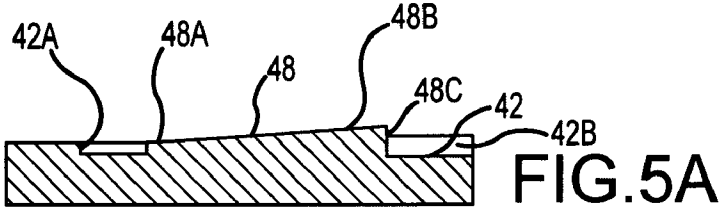
FIG. 5A is a cross section view taken from plane A-A of FIG. 5.
Figure 5:
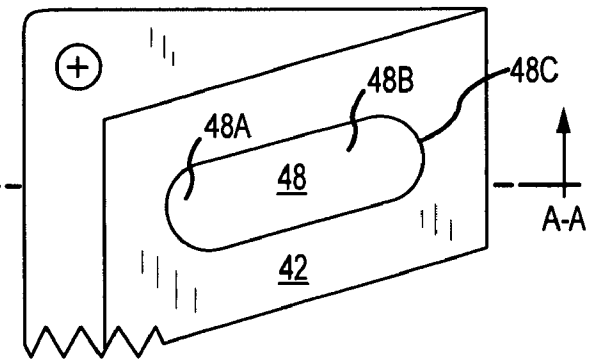
FIG. 5 is a magnified top view of the proximate portion of a blade holder.
Figure 4A:
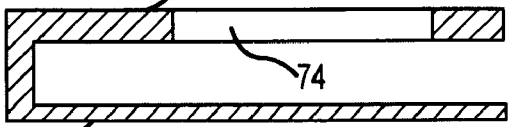
FIG. 4A is a cross section view taken from plane A-A of FIG. 4.
Figure 4:
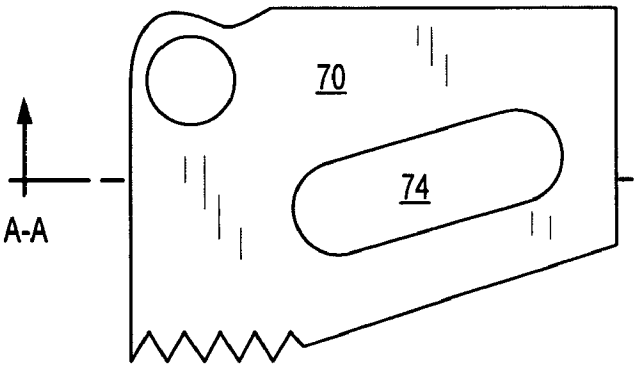
FIG. 4 is a magnified top view of the proximate portion of a blade lock.

Blade lock 70 secures and fixes replaceable blade 12 to blade holder 40. Blade lock 70 is pivotably mounted to blade holder 40 at pivot joint 72 and pivots between an opened position shown in FIGS. 2 and 6 and a closed position shown in FIGS. 3 and 9. The opened position shown in FIGS. 2 and 6 accommodates the removal and replacement of replaceable blade 12. Replaceable blade 12 is held in place when blade lock 70 is in the closed position shown in FIGS. 3 and 9. Pivot joint 72 is preferably located outside the perimeter of blade holder blade recess 42 and preferably proximate to corner of blade recess 42 corresponding to back edge 16 and base edge 18 of replaceable blade 12. As can be seen in FIGS. 3A and 3B, blade lock 70 is a channel shaped member adapted for fitting around blade holder 40. As can be seen in FIGS. 3A and 3B, channel shaped blade lock 70 includes a back flange 70A which generally covers the back surface of blade holder 40 and a front flange 70B which generally covers the front surface of blade holder 40. It is preferable that the shape of blade lock 70 generally corresponds to the shape of blade holder 40 and that blade lock 70 fits securely around blade holder 40 when in the closed position shown in FIGS. 3 and 9. When in the closed position, the front flange 70B of blade lock 70 extends over a portion of replaceable blade 12 adjacent to back edge 16. Also, when in the closed position a base edge 76 of blade lock 70 extends past boss 48 which projects from blade holder 40. Front flange 70B of blade lock 70 includes a boss opening 74 which corresponds to blade holder boss 48 projecting from blade holder 40.

As noted above, back edge portion 46 of blade holder 40 as well as the portion of blade recess 42 of blade holder 40 which extends into back edge portion 46 are preferably elongated and preferably extend most of the length of the straight portion of back edge 16 of blade 12 in order to support blade 12. Similarly, as noted above, when blade lock 70 is in the closed position and when blade 12 is mounted in blade holder 40, back flange 70A and front flange 70B of blade lock 70 surround back edge portion 46 of blade holder 40 as well as the portions of blade 12 adjacent to its back edge 16. Accordingly, because back edge 16 of blade 12 is extensively supported, blade 12 may be relatively thin, flexible and inexpensive and still function as a conventional knife blade. Because of this it is possible to produce, a sharp, high quality blade 12 which has a length comparable to the length of conventional knife blades, which when installed as described above functions in a way comparable to the knife blade of a conventional knife and which is sufficiently low in cost to allow economical removal and replacement.

FIGS. 6-9A provide detailed views of blade lock 70 and blade holder 40 showing how blade lock 70 engages blade holder 40 to hold blade 12 in place and also shows how blade lock 70 may be disengaged from blade holder 40 to allow the removal of a blade. More particularly, FIGS. 6-9 show how boss opening 74 in front flange 70B of blade lock 70 reacts to boss 48 as blade lock 70 is rotated from the opened position shown in FIG. 6 to the closed position shown in FIG. 9. The skilled reader should note that blade 12 has been omitted from FIGS. 6-9A for clarity. The distal ends of both the blade lock and the blade holder have also been broken away and removed in FIGS. 6-9A for clarity.

Figures 6, 6A, 6B, 6C:
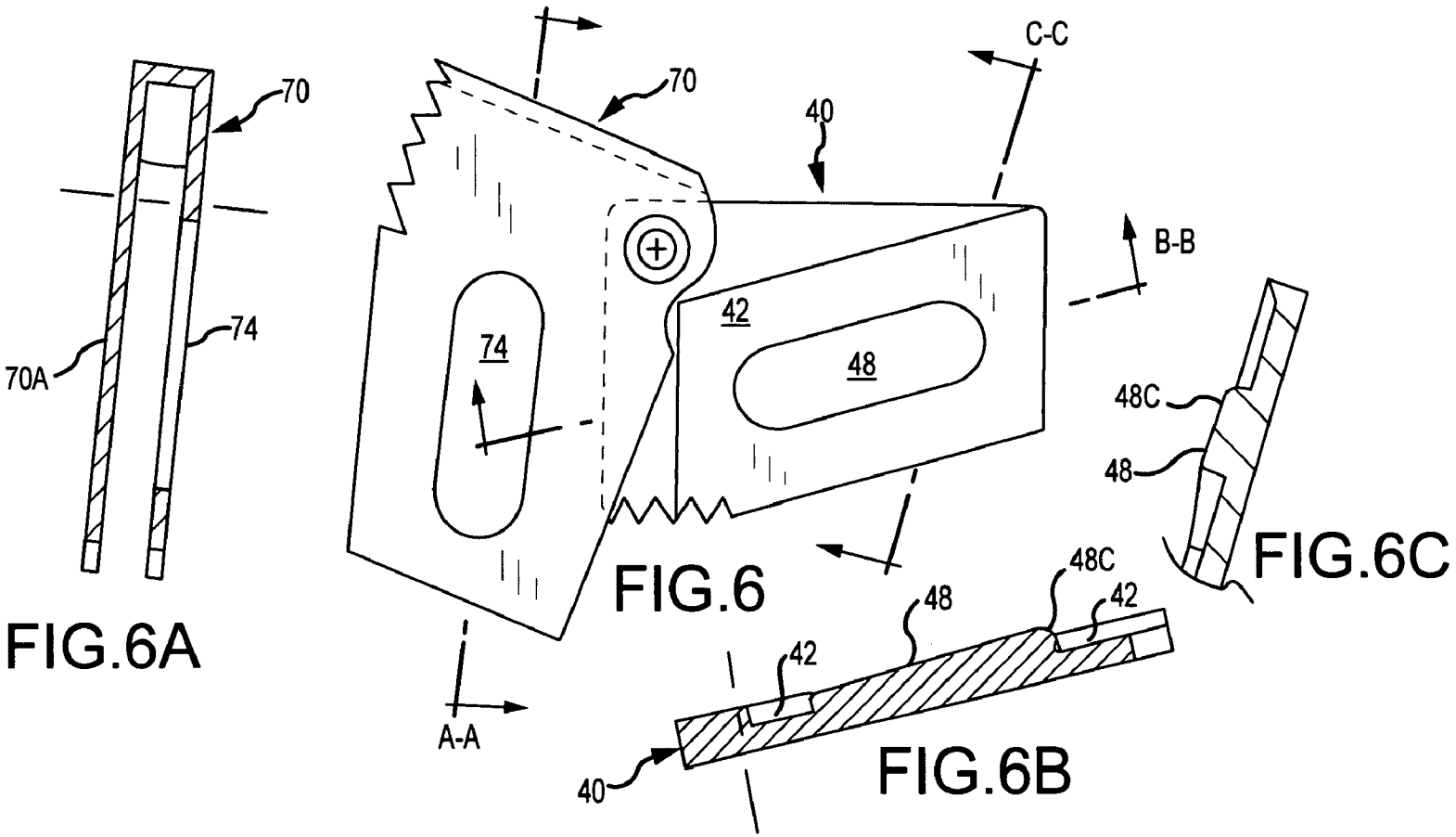
FIG. 6 is a magnified top view of the proximate portions of a blade holder and a blade lock with the blade lock in a fully opened position with the blade removed for clarity.
FIG. 6A is a cross section view taken from plane A-A of FIG. 6 showing a cross section of the blade lock with the blade holder removed for clarity.
FIG. 6B is a cross section view taken from plane B-B of FIG. 6 showing a first cross section of the blade holder with the blade lock removed for clarity.
FIG. 6C is a cross section view taken from plane C-C of FIG. 6 showing a second cross section of the blade holder with the blade lock removed for clarity.
Figure 7:
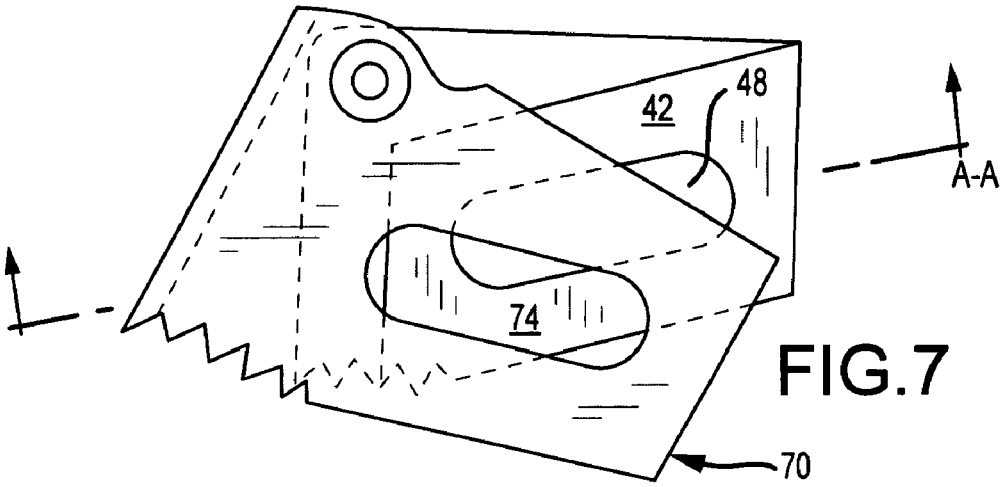
FIG. 7 is a magnified top view of the proximate portions of a blade holder and a blade lock with the blade lock shown between the opened position and the closed position with the blade removed for clarity.
Figure 7A:
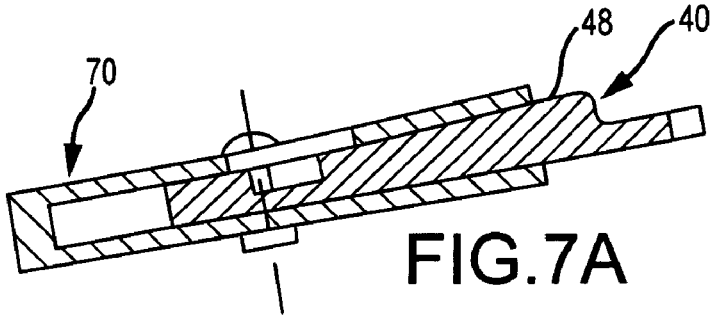
FIG. 7A is a cross section view taken from plane A-A of FIG. 7 showing a cross section of the blade lock and the blade holder shown with the blade holder between the opened position and the closed position.
Figure 8:
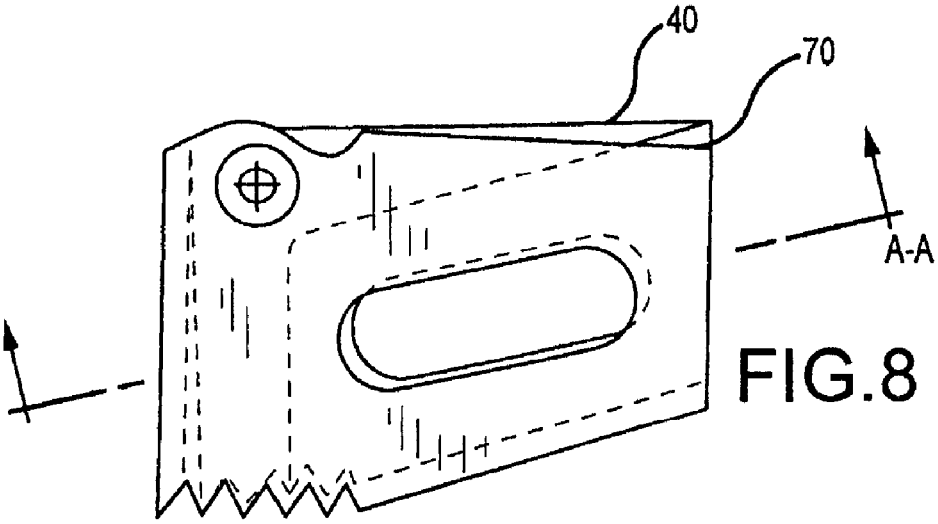
FIG. 8 is a magnified top view of the proximate portions of a blade holder and a blade lock with the blade lock approaching the closed position with the blade removed for clarity.
Figure 8A:
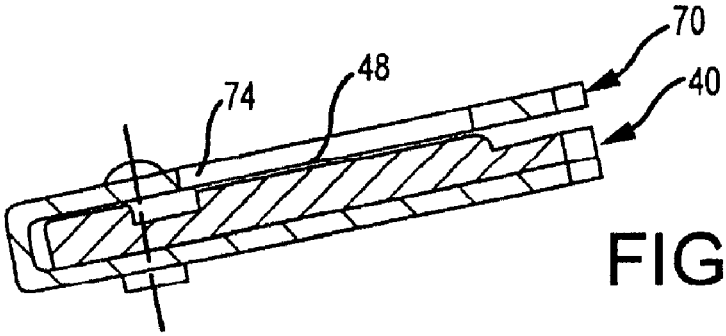
FIG. 8A is a cross section view taken from plane A-A of FIG. 8 showing a cross section of the blade lock and the blade holder with the blade holder approaching the closed position.

In FIG. 6, blade lock 70 is in the opened position. Blade recess 42 is completely uncovered allowing the removal or placement of a blade (not shown). FIG. 6 also corresponds to FIG. 2. FIG. 6A shows a cross section of blade lock 70 alone taken from plane A-A which longitudinally bisects opening 74. FIG. 6B shows a cross section of blade holder 40 only taken from plane B-B which bisects boss 48. As can be seen in FIG. 6B, boss 48 gently slopes from a low portion 48A to a high portion 48B.

Figure 9:
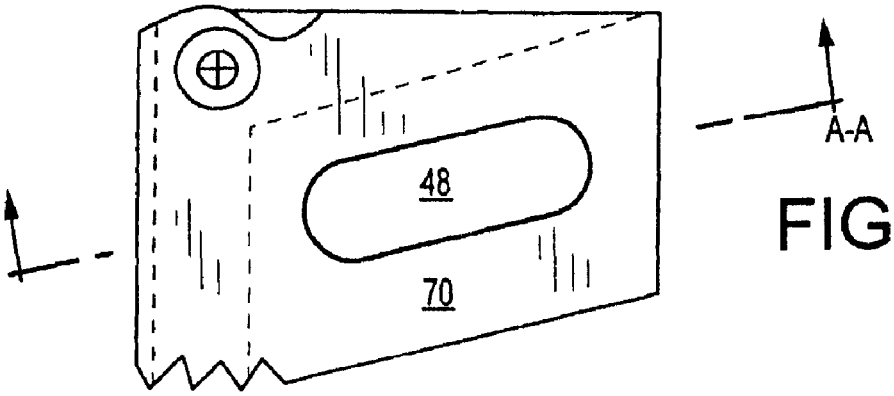
FIG. 9 is a magnified top view of the proximate portions of a blade holder and a blade lock with the blade lock in the closed position with the blade removed for clarity.
Figure 9A:
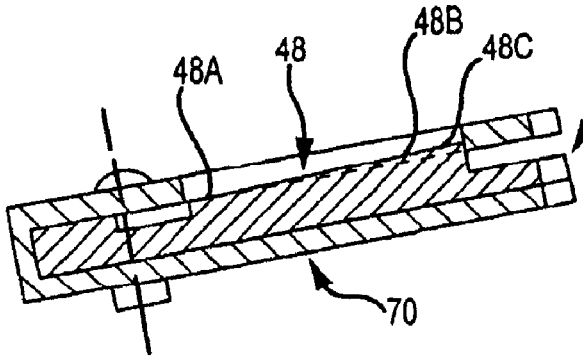
FIG. 9A is a cross section view taken from plane A-A of FIG. 9 showing a cross section of the blade lock and the blade holder with the blade holder in the closed position with the blade removed for clarity.

If all of the edges of boss opening 74 and boss 48 were perfectly square, the initial force required to open blade lock 70 from a closed position might be unacceptably large. Accordingly, one or both of the edges of boss opening 74 and boss 48 should be rounded or beveled in those areas which initially engage as blade lock 70 begins to rotate away from the closed position. As can be best seen in FIGS. 6B and 6C, in this example embodiment, the upper outside edge 48C of boss 48 is beveled to allow the corresponding lower inside edge of boss opening 74 to ride up onto boss 48. This action makes it possible to further rotate blade lock 70 toward the opened position shown in FIG. 6. Thus an operator wishing to pivot blade lock 70 from the closed position as shown in FIG. 9 to the opened position shown in FIG. 6, would exert a clockwise force on the end of blade lock 70 most distant from pivot joint 72. The beveled portion of boss 48 should be configured so that blade lock 70 may be opened with a moderate manual force but also so that blade lock 70 will not open during normal use of knife 10. As with blade holder 40, blade lock 70 should be fashioned from a strong, tough material such as stainless steel.

Figure 10:
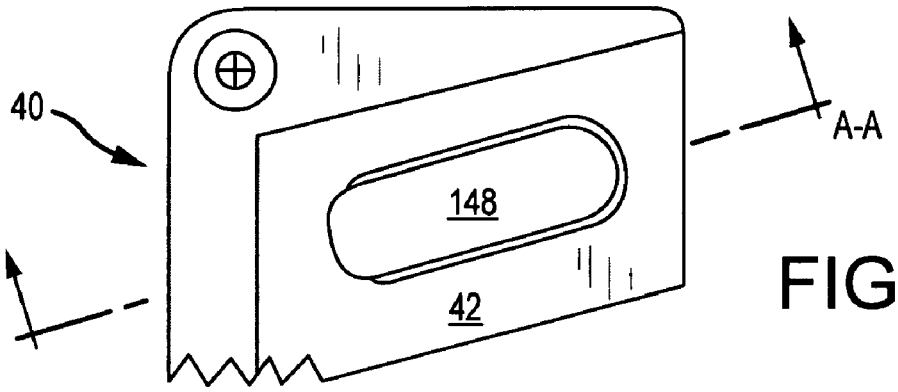
FIG. 10 is a magnified top view of the proximate portions of a blade holder with the blade removed for clarity showing an alternate boss which is biased in a locked position.
Figure 10A:
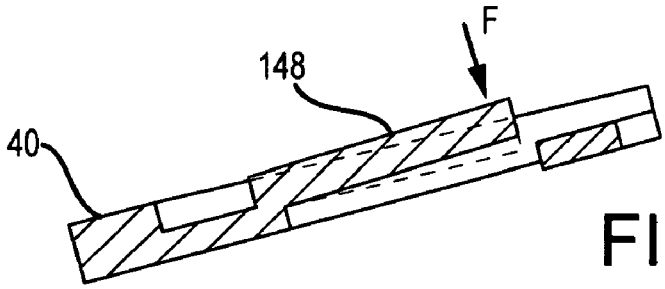
FIG. 10A is a cross section view taken from plane A-A of FIG. 10 showing a cross section of the blade holder with the blade removed for clarity showing an alternate boss which is biased in a locked position.

Beveling or rounding the proximate edge of boss 48 as shown and described above or the proximate inside edge of boss opening 74 of blade lock 70 or beveling or rounding both edges is merely one method for providing a means for allowing passage of blade lock front flange 70B over boss 48 to allow opening of blade lock 70. FIGS. 10 and 10A show an alternate method for providing a means for allowing passage of blade lock front flange 70B when pivoting blade lock 70 from the closed position to the opened position. In FIGS. 10 and 10A, boss 148 is fashioned as a resilient prong which is fixed to blade holder 40 at a base 148A. This arrangement is sufficiently flexible to permit boss 148 to deflect under moderate manual pressure from the locked position shown in FIG. 10A with solid lines to the unlocked position shown in FIG. 10A with dashed lines. Blade holder 40 now includes an cavity 140A for allowing boss 148 to deflect towards the back surface of blade holder 40. As can be seen in FIG. 10, cavity 140A is sized to provide clearance for the downward flexure to boss 148 in response to finger pressure applied at arrow P shown in FIG. 10A. Boss 148 may be an integral part of blade holder 40 as shown in FIG. 10A or boss 148 may be a separate part which is fixed to blade holder 40 by welding or fasteners. Boss 148 should be fashioned from a tough, elastic material such as stainless steel. At a minimum, boss 148 should be fashioned from a tough material having an elastic range sufficient to allow enough deflection of prong 148 to permit an operator to open blade lock 70 without causing the plastic deformation of boss 148.

Figure 11:
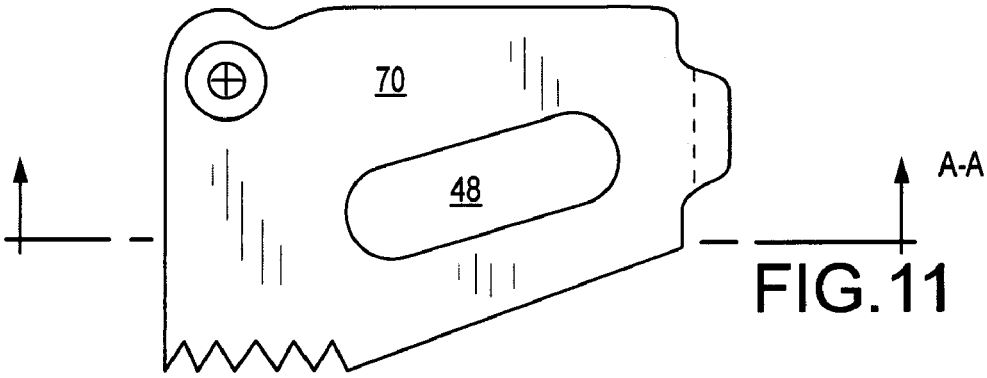
FIG. 11 is a magnified top view of the proximate portions of a blade holder with the blade removed for clarity showing an alternate thumb flange extending from the thumb holder.
Figure 11A:
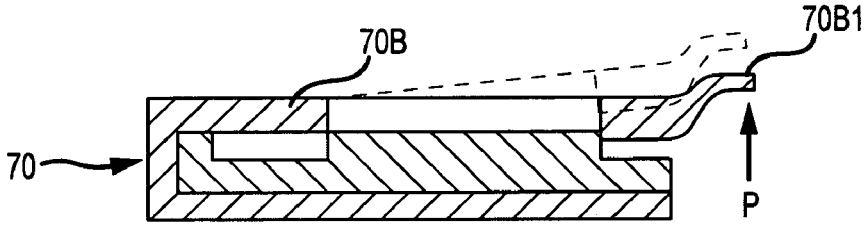
FIG. 11A is a cross section view taken from plane A-A of FIG. 11 showing a cross section of the blade holder with the blade removed for clarity showing an alternate thumb flange extending from the thumb holder.

FIGS. 11 and 11A show yet a second alternate method for disengaging blade lock 70 from blade holder 40. In FIG. 11A, manual pressure P is applied to an alternate thumb catch flange 70B1 projecting from the outside edge of blade lock front flange 70B adjacent to boss opening 74 to cause front flange 70B to deflect sufficiently to clear high portion 48B of boss 48 as shown with the superimposed dashed lines in FIG. 11A. This approach could eliminate the need for rounding or beveling either the edges of boss 48 or corresponding inside edges of boss opening 74.

Pivot joint 72 may also include a hinge pin which extends beyond the surfaces of the back and front flanges of blade lock 70. Such a hinge pin would be useful if blade holder 40 were in turn pivotably mounted to handle 11 for retracting within handle 11. A skilled user could manipulate a hinge pin at pivot joint 72 with one hand in order to open the knife with one hand. Thus pivot joint 72 may be a dual use part.

As can be seen from the above detailed description, replacement blade knife 10 satisfies the objectives of the invention. Replaceable blade 12 can be removed and replaced with a fresh, factory sharp blade when blade 12 becomes dull. Moreover, as noted above, replaceable blade 12 may be removed and replaced with either an identical replacement blade or any one of a multitude of specialized knife blades, saw blades or tool elements. This capability greatly increases the versatility of the knife.

It is to be understood that while certain forms of this invention have been illustrated and described, it is not limited thereto, except in so far as such limitations are included in the following claims and allowable equivalents thereof:

1. A knife with a replaceable blade comprising:

(a) a blade having a bottom cutting edge and an opposing back edge, a proximal base edge and an a blade opening spaced away from the back edge and spaced distally of the proximal base edge;

(b) a blade holder secured to a handle, the blade holder having a longitudinally extending shoulder defined between an upper portion and a recessed lower portion and a raised boss extending outwardly from a proximal portion of the lower portion, the blade being positioned on the blade holder with the blade opening receiving the raised boss therein and the blade back edge lying against the shoulder; and (c) a blade lock pivotally mounted to the knife and movable between open and closed positions, the blade lock having spaced apart front and rear portions and a back edge portion integral with the front and rear portions, when in the closed position, at least a portion of the blade lock defines a structure overlying the front and rear sides of the blade holder as well as at least a portion of the blade back edge that lies against the shoulder, whereby, the blade is secured in the blade holder when the blade lock is in the closed position and the blade is removable from the blade holder when the blade lock is in the open position; and, (d) a locking feature for releasably securing the blade lock to the blade holder when the blade lock is in the closed position.

2. The knife as in claim 1, wherein; said locking feature is an opening in the blade lock operable for receiving the raised boss of the blade holder when the blade lock is in the closed position.

3. The knife as in claim 1, wherein;

the back edge portion of the blade is extensively supported by contact with the longitudinally extending shoulder and the blade holder.

4. The knife as in claim 1, wherein;

the back edge of the blade is encased between the blade holder and the blade lock when the blade lock is in the closed position.

5. The knife as in claim 1, wherein;

the blade lock is pivotally mounted to the blade holder.

* * * * *